United States Patent [19]

Wells et al.

[11] Patent Number: 4,827,139

[45] Date of Patent: May 2, 1989

[54] SPENT NUCLEAR FUEL SHIPPING BASKET AND CASK

[75] Inventors: Alan H. Wells, Duluth; Thomas C. Thompson, Lawrenceville, both of Ga.

[73] Assignee: Nuclear Assurance Corporation, Norcross, Ga.

[21] Appl. No.: 40,068

[22] Filed: Apr. 20, 1987

[51] Int. Cl.[4] ..... G21F 5/00

[52] U.S. Cl. ..... 250/507.1; 250/506.1

[58] Field of Search ..... 250/507.1, 506.1; 376/272; 252/633

[56] References Cited

U.S. PATENT DOCUMENTS 3,731,101 5/1973 Peterson et al. ..... 250/506.1
4,096,392 6/1978 Rubinstein et al. ..... 376/272
4,319,960 3/1982 Larson et al. ..... 250/506.1
4,543,488 9/1985 Diem ..... 250/506.1

*Primary Examiner*—Bruce C. Anderson
*Assistant Examiner*—Jack I. Berman
*Attorney, Agent, or Firm*—David P. Kelley

[57] ABSTRACT

A spent nuclear fuel shipping basket has a plurality of tubes of corrosion resistant material, each tube being adapted to contain a spent nuclear fuel rod assembly. The tubes are arranged in a geometric pattern within a circular cask, and are totally independent of each other, with neutron poisoning material between adjacent tubes. Filler blocks of heat absorbing material which may also contain neutron poisoning material are inserted into the empty spaces between the tubes and the wall of the cask, and are independent of both tubes and wall.

13 Claims, 3 Drawing Sheets

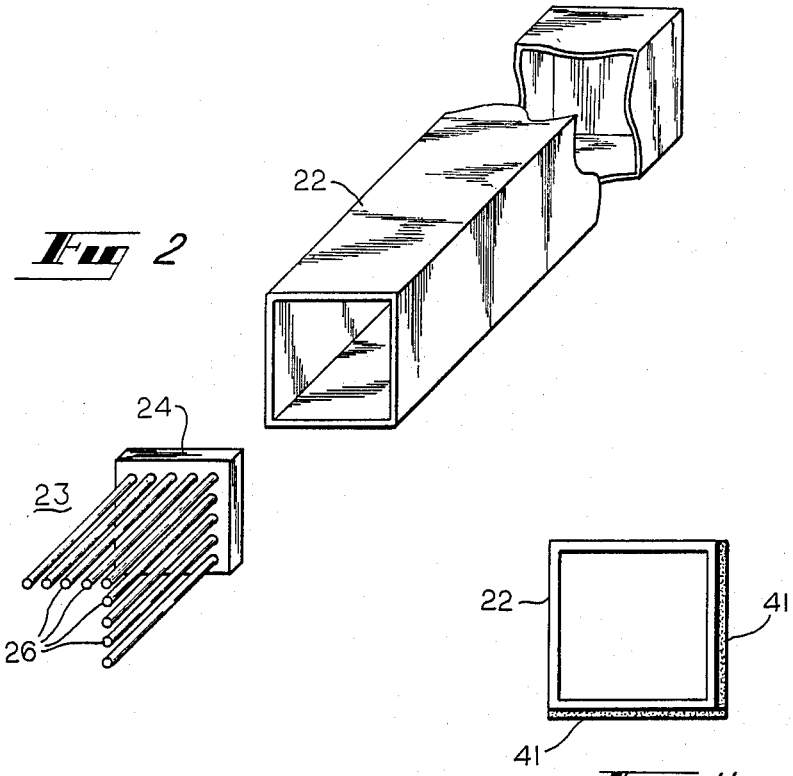
Fig 2
Fig 4
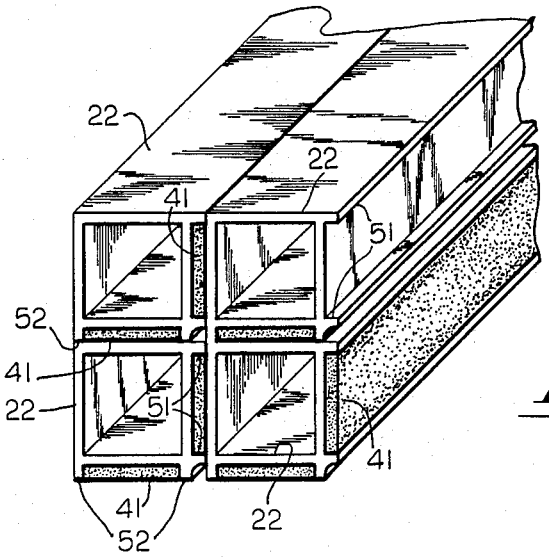
Fig 5

TABLE I

| BASKET TYPE | LOCATION OF MAXIMUM STRESS | | | RELATIVE STRESS | | |
|---|---|---|---|---|---|---|
| SOLID OR WELDED | 0° | 45° | 90° | 0° | 45° | 90° |
| | A | B | C | 1.1 | 1.3 | 1.0 |
| INDEPENDENT COMPONENT | A | B | D | 1.0 | 1.15 | 1.0 |

TABLE II

| BASKET TYPE | LOCATION OF MAXIMUM STRESS | DIFFERENTIAL THERMAL EXPANSION STRESS |
|---|---|---|
| SOLID OR WELDED | E | 1.00 |
| INDEPENDENT COMPONENT | E | 0.33 |

SPENT NUCLEAR FUEL SHIPPING BASKET AND CASK

BACKGROUND OF THE INVENTION

In a nuclear reactor, the fissionable nuclear fuel is, most frequently, in the form of a plurality of individual rods assembled into a bundle of substantially square cross-sections, in such a manner that the rods are held in fixed, spaced relationship. Over a prolonged period of operation of the reactor, the fissionable fuel becomes depleted to the point where it no longer is capable of maintaining or fueling a fission reaction. When this state is reached, it is necessary to remove the rod assembly and replace it with a fresh one. The depleted rod assembly is still of potential value, however, since the rods are still highly radioactive and can be reprocessed in a suitable facility to become capable of sustaining or fueling a fission reaction.

Inasmuch as reprocessing facilities are, more often than not, far removed from the nuclear reactor, it is necessary to ship the spent fuel over long distances, in as safe a manner as possible, both to the outside world and to the rod assembly itself. In order to insure the extreme degree of safety required, the rod assemble is generally loaded into a fuel basket which, in turn, is contained in a shipping cask. It is imperative that the basket and cask assembly be so constructed that harmful radiation does not escape, that the heat generated by the radioactive decay of the spent fuel is adequately dissipated, and that radioactive interaction between the fuel cells is kept below a critical level.

To achieve these ends, numerous types of fuel cells shipping containers have been designed and used, examples of which are disclosed in U.S. Pat. Nos. 4,292,528 of Shaffer et al, 4,543,488 of Diem, 3,962,587 of Dufrance et al, and 4,399,366 of Bucholz.

The Schaffer et al patent discloses a cask for radioactive material in which a plurality of internal fuel containing compartments are formed by a modular construction of surrounding heat conducting members and joined together as by welding, brazing, cementing, or mechanical interfitting. Neutron absorbing material is incorporated into the structure to suppress interaction between the fuel in adjacent compartments. Thus, Shaffer et al achieve the ends of heat dissipation and interaction suppression, as well as radiation suppression through the use of, for example lead shielding.

Diem discloses a basket in which the individual fuel containing tubes are embedded, along with neutron absorbing plates, in a casting of high heat conductivity material, thereby creating an essentially solid, unitary structure having fuel containing tubes extending longitudinally therethrough.

Dufrance et al disclose a basket and cask arrangement in which the basket is suspended within the surrounding cask by a plurality of metallic septa which are for coolant containing chambers. The septa are bonded to the basket and the outer shell to hold the basket firmly in its central orientation.

Bucholz discloses a honeycomb-type structure for the fuel basket which defines a plurality of parallel tubes or cavities for holding the fuel cells. Neutron absorbing material is embedded within the walls of the honeycomb structure in the form of tubes, which may be filled with water to trap neutrons. The walls themselves function as heat conductors to the outer or cask wall.

In all of the foregoing, the aims of suppressed interaction, heat dissipation, and radiation suppression are achieved. However, in these structures, as well as in much of the prior art, the problem of sudden dynamic shock and load in the event of an accident during handling or transportation is not addressed. The dynamic stresses imposed on the fuel basket in the event of an accident, such as, for example, a thirty foot fall by the cask onto an unyielding surface, can be and often are, catastrophic. Structural analysis of state-of-the-art type baskets under impact loading has shown that such baskets tend to suffer greatest stresses at points removed from the point of impact, and that multiple failures of the fuel containing tubes can occur. Further, such analysis has shown that in a substantialy unitary structure as shown in the Diem and Bucholz patents, there can be a failure or rupture of a plurality of fuel containing tubes or cells. A modular structure such as the Shaffer et al arrangement is also susceptible to catastrophic failure, since the tubes are actually formed of a plurality of pieces attached to each other, the points of attachment representing low stress resistance. In like manner, the septa of Dufrance et al are susceptible to detachment from the inner wall of the cask and from the wall of the basket under sudden heavy stress.

SUMMARY OF THE INVENTION

The present invention through its unique basket structure, achieves the desiderata of radiation and interaction suppression and heat dissipation, and, in addition, is less susceptible to catastrophic or widespread dynamic stress damage than prior art baskets.

In one preferred embodiment of the invention, the fuel rod assembly containers, i.e., tubes, are seamless metallic members formed by casting, swaging, or other suitable means whose inside dimensions and shape are such that the rod assembly is essentially slip-fitted into the tube. The tubes are arranged into a pattern within the circular cask, with neutron poisoning spacers between adjacent tubes. The empty spaces resulting from an assemblage of substantially square tubes within a circular cavity are filled by filler blocks of suitable heat absorbing material which may also contain neutron poisoning material, if necessary. The entire assembly, rigid tubes, spacers, and filler blocks within a rigid wall cavity is itself rigid, with each element of the assembly held firmly in place by adjacent elements so that there is no relative motion between the elements under normal conditions, despite the fact that none of the elements of the assembly is attached or affixed to any other element.

Because the various elements are not attached or connected to each other, in the event of a dynamic stress producing accident, such as the aforementioned thirty foot fall of the cask to impact upon an unyielding surface, the stresses produced are not transferred as readily to adjacent elements, and while elements along the axis of impact may be damaged, the stresses do not spread throughout the structure and damage substantially all of the element, especially the rigid, seamless tubes. Thus damage is not widespread or catastrophic, and a substantial margin of safety is, unlike in the prior art, maintained. Not only does the structure of the invention limit impact damage, it also limits stresses due to differential thermal expansion, as where some warping or bending of the walls of one of the tubes is not transferred as deformation stress to other adjacent tubes.

In other embodiments of the invention, the spacers may be attached to the walls of the tubes principally to facilitate handling, and assembly of the basket, or alternatively, the tubes may be so formed that any pair of adjacent tubes forms a pocket between the tubes into which the neutron poisoning spacer is slipped and held in position.

These and other features of the present invention will be more readily apparent from the following detailed description and the accompanying drawings.

DESCRIPTION OF THE DRAWINGS

FIG. 2 is a perspective view of a spent fuel containing tube and its relationship to a fuel rod assembly;

FIG. 4 is a second embodiment of the fuel containing tube of the invention; and

FIG. 5 is another embodiment of the fuel containing tube of the invention.

DETAILED DESCRIPTION

Figure 1:
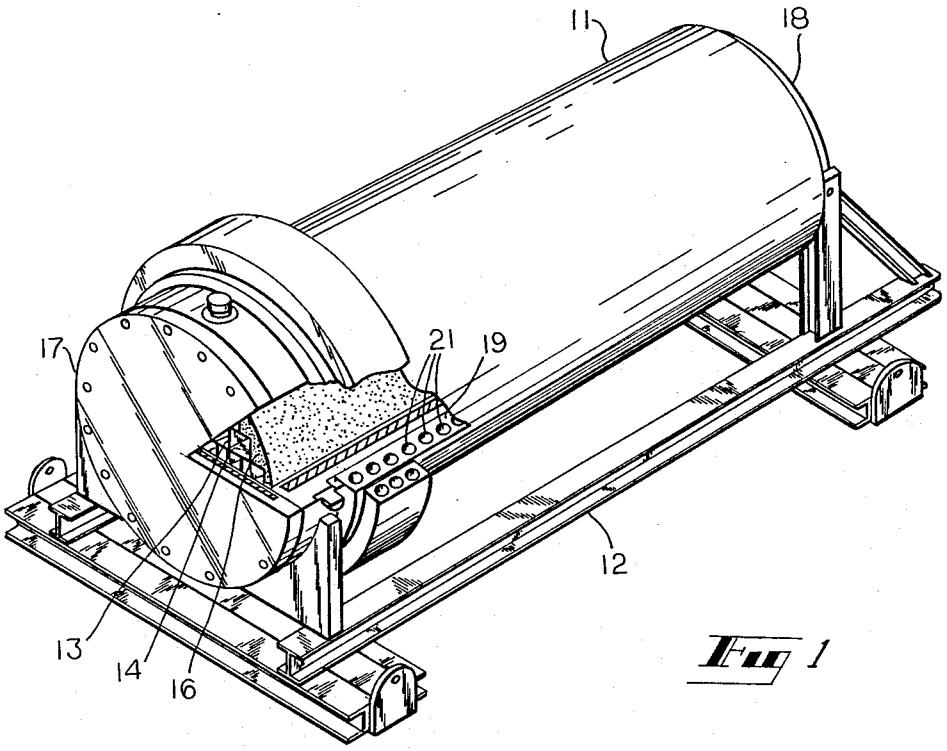
FIG. 1 is a perspective view of a spent fuel cask and shipping cradle.

In FIG. 1 there is shown, for purposes of illustration and to facilitate an understanding of the ensuing discussion, a typical spent nuclear fuel shipping cask 11, mounted in its shipping cradle 12. The outer shell of cask 11 may be of steel or other suitable strong material. Within cask 11 is contained a spent nuclear fuel basket 13, consisting of a number of elongated tubes or cells 14 into which the nuclear fuel rod assemblies (not shown) are inserted for transport. Any empty spaces between the basket 13 and the shell of cask 11 may be filled with filler blocks 16 of suitable material to hold the basket 13 in place within the cask 11. The cask 11 is sealed with end plates 17 and 18 for holding the basket assembly in place longitudinally. The cask itself may include an outer jacket 19, having a plurality of channels 21, 21 containing water, for example, for containing neutrons emitted from the fuel cells and also for cooling.

In FIG. 2 there is shown, in perspective, a tube member 22 for use in the basket of the present invention. For illustrative purposes, a portion of a fuel rod assembly 23 is shown, consisting of a square base 24 and fuel rods 26, 26 mounted thereon. Tube 22 is preferably made by extrusion of aluminum or a boron-aluminum alloy to form a seamless tube forming a hollow, square holding cell of dimensions such that the fuel rod assembly 23 is virtually slip-fitted therein so that it is held snugly within tube 22. Instead of extrusion, the tube 22 may be formed by swaging, or by welding along one edge thereof. This last expedient is the least desirable, but, as will be apparent hereinafter, in the overall construction of the basket the single, strong weld will not be overly deleterious to the function and stress resistance of the basket. It is also possible to make the tube 22 of stainless steel or other non-corrosive material, although aluminum is preferred for a variety of reasons, among which is its better heat conductivity, and the fact that, when alloyed with boron, it functions as a neutron poisoning material, thereby restricting large amounts of neutron interaction between the fuel cells.

Figures 3, 3A:
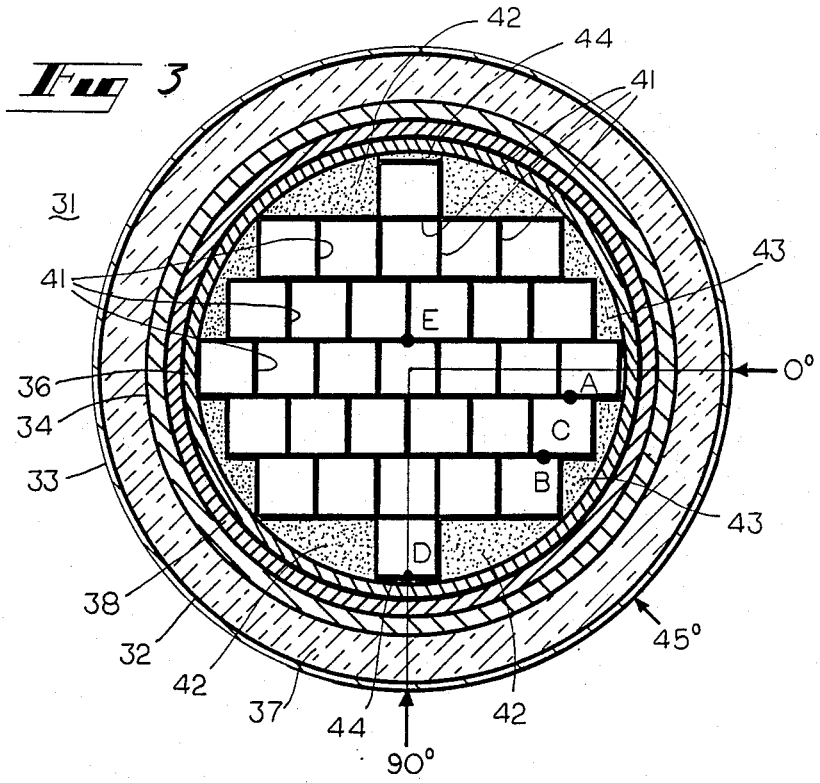
FIG. 3 is an elevational view of the cross-section of the fuel basket and cask of the present invention.
FIG. 3A shows two tables, Table I and Table II, which depict the stress distribution figures for the arrangement of FIG. 3 and for a prior art cask assembly.

FIG. 3 depicts a fuel basket and cask assembly 31 embodying the principles of the present invention. The cask 32 of assembly 31 comprises three spaced concentric rings or shells 33, 3, and 36 of, for example, steel. The space 37 between rings 33 and 34 may be filled, for example, with water, which functions to suppress neutron radiation, and, to some extent also functions as a coolant. Alternatively, the space 37 may be filled with a hydrogen containing material such as, for example, Bisco® NS4FR. Also, the hydrogen containing material may have ducts or passages (not shown) containing water. If water alone is used in space 37, the spacing between rings 33 and 34 may be maintained by suitable webs (not shown) of sufficient number to maintain a high degree of structural strength.

The space 38 between rings 34 and 36 is preferably filled with lead, which blocks gamma radiation from the fuel rods.

Inside of ring 36 is the basket assembly embodying the principles of the present invention. The basket 39 comprise a plurality of fuel containing tubes 22 arranged in the stack pattern shown to maximize the number of tubes within the inner ring or shell 36. Each tube is totally independent of every other tube, there being no physical connection between any of the tubes, although the individual tubes are adapted to maintain adjacent tubes in position along at least one axis in the pattern shown. Between adjacent tubes in the assembly are inserted spacer slabs 41, 41, of a neutron poising material such as an alloy of boron and aluminum. One such material is known as Boral®. The slabe 41, may be attached to an adjacent tube, for ease of assembly, but in no case is a slab 41 connected to two adjacent tubes.

The entire assembly of tubes 22 with spacers 41 is maintained firmly in position relative to each other and the inner shell 36 of the cask by filler blocks 42, 43, and 44, which are preferably extruded from a neutron poisoning material such as an alloy of aluminum and boron, e.g., Boral®, and inserted into the spacer formed by the pattern of the assembly and the circular surrounding wall 35. Because various tolerances are involved in the tube dimensions and the wall or ring 36, some slight machining of the filler blocks 42, 43, 44 may be necessary to achieve a substantially slip fit in the assembly. Blocks 42, 43, and 44 function not only as neutron poisoning members, but also as heat conductors. When the filler blocks have been inserted into the assembly, the basket 39, although made up of a number of totally independent components, is, to all intents and purposes, a rigid structure, and under normal transporting and handling conditions, is as rigid as various prior art structures.

Under other than normal conditions, i.e., where various stresses are introduced, the structure of the present invention, where substantially all of the elements are independent of each other, is better able to withstand these stresses. Referring now to FIG. 3 and Tables I and II, the affect of various stresses on a typical prior art basket and the basket of the present invention is shown, based upon a stress analysis in which three different impact conditions and one condition of differential thermal expansion were considered.

The analysis showed that for a side drop of the cask (as opposed to an end drop, where stresses are quite small), stress was at a maximum for a 45° orientation of the basket to the point of impact, and the maximum at the point B, shown in FIG. 3, for both the prior art basket and the basket of the present invention. However, as shown in Table II, the relative stress at point B was approximately 12% less for the basket of the present invention. In the same manner, for a zero degree orientation, maximum stress occurred at point A as seen in FIG. 3, but the relative stress was approximately 9% less in the basket of the present invention. For a 90° orientation, relative stresses were the same, although for the prior art basket, maximum stress occurred at point C, whereas it occurred at point D for the basket of the invention. This last indicates the efficacy of the theory underlying the structure of the present invention. Although the point of impact was at 90° as shown in FIG. 3, for the prior art basket, the stress travelled through the structures, increasing to a maximum at point C, because being a solid, connected structure, the stress was transmitted through a number of tubes to the point of maximum stress, thus representing potential, and most probably actual damage to all of the intervening tubes. On the other hand, for the basket of the invention, the single tube at point D absorbed most of the impact because is was, or is, independent of the other tubes which are themselves independent, so that stresses are not readily transmitted. Because the tubes are independent of each other, under conditions of extreme stress there is presented at their boundaries, i.e., walls, a high impedance to the transmission of the stress to adjacent tubes.

As can be seen in Table II, the behavior under conditions of differential thermal expansion are even more pronounced. Assuming a maximum differential thermal expansion stress at point E, the stress for a solid or welded basket structure is approximately three times as great as for the structure of the invention. This can be at least partially explained by the fact that in a solid or welded structure all of the tubes are interdependent, actually presenting a unitary structure to the stress, while in applicants' basket, all tubes are independent of each other and stress on one does not imply stress on all. Earlier it was mentioned that the tube 22 could be fabricated by welding along one edge. Welding is not desirable, since welds are susceptible to stresses and tend to crack and break under heavy stress. However, because all of the tubes 22 are independent of each other, the damage caused by a breaking weld is limited to the tube on which the weld is located and the remaining tubes are substantially unaffected.

FIG. 4 depicts a tube 22 to which the aluminum-boron spacer slabs 41, 41 are affixed as by welding, brazing or other suitable means, to only two sides. It can be seen that in a pattern of tubes such as is shown in FIG. 3, this is all that is necessary to insure that there will be a spacer between any pair of adjacent tubes. In this configuration, the spacer becomes a part of the tube, which still remains independent of all other tubes and spacers. The arrangement of FIG. 4 facilitates assembly of the basket in the desired pattern, eliminating the difficulty of inserting the spacer slabs into place.

FIG. 5 depicts a modified version of the tubes 22, also intended to facilitate assembly and insure proper location of the spacers 41. Each of the tubes 22 is provided with two pairs of locating tabs 51, 51, and 52, 52, extending the length of the tube. The tabs are formed during the extrusion formation of the tube 22. The depth of the tab is substantially the same as the thickness of the spacer 41, for example, 0.170 inches. The tabs, as can be seen from FIG. 5, in conjunction with the untabbed wall of the adjacent tube, form a pocket for insertion of the spacer, which is substantially a slip fit therein. As can be seen in FIG. 5, only two sides of each tube 22 need to be tabbed, thereby insuring that there will be a spacer between each pair of adjacent tubes.

It is readily apparent from the foregoing that the invention comprises a new spent fuel basket assembly that is less susceptible to damage or failure arising from the application of dynamic stresses to the cask or basket. While the foregoing illustrative embodiments of the invention represent preferred forms thereof, various modifications and changes may occur to persons skilled in the art without departure from the spirit and scope of the invention.

We claim:

1. A basket for a cask for transporting nuclear fuel elements comprising a plurality of tubes of non-corrosive material, each of said tubes having internal cross-section dimension for receiving a nuclear fuel assembly such that the assembly is held firmly in place within said tubes, said plurality of tubes being arranged in a stacked pattern to fit within a cask, each said tubes being independent of every other tube in said stacked pattern such that the transfer of stresses from tube to tube is impeded and being adapted to maintain adjacent tubes in position within the stack along at least one axis, a plurality of filler block members adapted to be inserted between the stacked tubes and the inner wall of the cask to fill the empty spaces therebetween, each of said filler block members being indpendent of each other, the tubes in the stacked pattern, and the inner wall of the cask to impede the transfer of stresses throughout the basket and cask structure, the shape and dimensions of said filler blocks being such that when the blocks are assembled with the stacked tubes and inserted into the cask, the entire basket, including said tubes, is held rigidly in place within the cask.

2. The basket as claimed in claim 1 and further comprising spacer members of neutron poisoning material between each pair of adjacent tubes.

3. The basket as claimed in claim 2 wherein each of said spacer members is made of an alloy of aluminum and boron.

4. The basket as claimed in claim 2 wherein the said spacer members are independent of each of the adjacent ones of said tubes.

5. The basket as claimed in claim 2 wherein two of said spacer members are affixed to each one of said tubes along abutting sides thereof.

6. A basket for a cask for transporting spent nuclear fuel elements comprising, a plurality of seamless tubes of non-corrosive material, each of said tubes having internal cross-sectioned dimensions for receiving a spent nuclear fuel assembly such that the assembly is held firmly in place within said tubes, said plurality of tubes being arranged in a stacked pattern to fit within a cask, each of said tubes being independent of every other tube in said stacked pattern such that the transfer of stresses from tube to tube is impeded, and being adapted to maintain adjacent tubes in position within the stack along at least one axis, spacer members of neutron poisoning material located between adjacent tubes within the stack, a plurality of filler block members of heat conducting neutron poisoning material adapted to be inserted between the stacked tubes and the inner wall of the cask to fill the empty spaces therebetween, each of said filler block members being independent of each other, the tubes in the stacked pattern, and the inner wall of the cask to impede the transfer of stresses throughout the basket and cask structure, the shape and dimensions of said filler blocks being such that when the blocks are assembled with the stacked tubes and inserted into the cask, the entire basket including said tubes and said spacers is held rigidly in place with the cask.

7. A basket as claimed in claim 6 wherein said tubes are of aluminum.

8. A basket as claimed in claim 6 wherein said tubes are of stainless steel.

9. A basket as claimed in claim 6 wherein said tubes are of an alloy of aluminum and boron.

10. A basket as claimed in claim 6 wherein said spacer members are formed of an alloy of aluminum and boron.

11. A basket as claimed in claim 6 wherein each of said tubes has two pairs of locating tabs extending lengthwise along the edges of two abutting sides of said tubes.

12. A basket and cask assembly for transporting spent nuclear fuel assemblies comprising a cask having an outer shell, and intermediate shell spaced from said outer shell, and an inner shell spaced from said intermediate shell, the space between said outer shell and said intermediate shell containing neutron radiation absorbing material, the space between said intermediate shell and said inner shell containing gamma radiation blocking material, and the space within the inner shell being filled with a basket comprising a plurality of tubes of non-corrosive material extending longitudinally of said cask, said tubes being arranged in a stack pattern designed to maximize the number of tubes within said inner shell and each of said tubes having internal cross-section dimensions for receiving a nuclear fuel assembly is held firmly in place within said tube, each of said tubes in said pattern being independent of every other tube in said pattern such that the transfer of stresses from tube to tube is impeded, and being adapted to maintain adajcent tubes in position in said stack pattern along at least one axis, at least one spacer member of neutron poisoning material positioned between adjacent tubes in said stack pattern, a plurality of filler block members adapted to be inserted between the stacked tubes and said inner shell to fill substantially completely the empty spaces therebetween, each of said filler block members being independent of each other, the tubes in said stack pattern, and said inner shell to impede the transfer of stresses throughout the basket and cask structure, the shape and dimensions of said filler blocks being such that the entire basket, including said tubes is held rigidly in place within said inner shell.

13. A basket and cask assembly as claimed in claim 11 wherein each of said tubes is a seamless hollow member formed of extruded aluminum containing material.

* * * * *